United States Patent [19]

Haberstroh

[11] 4,047,472

[45] Sept. 13, 1977

[54] APPARATUS FOR OPTICALLY MARKING PREDETERMINED POSITIONS IN A STACK OF DOCUMENTS

[75] Inventor: Markus Haberstroh, Munich, Germany

[73] Assignee: G.A.O. Gesellschaft fur Automation und Organisation mbH, Germany

[21] Appl. No.: 665,701

[22] Filed: Mar. 11, 1976

Related U.S. Application Data

[63] Continuation-in-part of Ser. No. 527,763, Nov. 27, 1974, abandoned.

[30] Foreign Application Priority Data

Dec. 12, 1973 Austria ..... 10379/73

[51] Int. Cl.[2] ..... B31B 1/98

[52] U.S. Cl. ..... 93/93 D; 93/93 R; 271/178

[58] Field of Search ..... 270/45, 52, 54–56, 270/58, 60; 271/178, 181; 93/93 D, 93 R, 93 DP, 93 K

[56] References Cited

U.S. PATENT DOCUMENTS

| | | | |
|---|---|---|---|
| 3,236,162 | 2/1966 | Reist | 93/93 DP |
| 3,662,875 | 5/1972 | Salomon | 93/93 DP X |
| 3,831,505 | 8/1974 | Skogsberg | 93/93 DP |

FOREIGN PATENT DOCUMENTS

| | | | |
|---|---|---|---|
| 635,787 | 9/1936 | Germany | 271/87 |
| 1,136,703 | 12/1968 | United Kingdom | 271/178 |

*Primary Examiner*—James F. Coan
*Attorney, Agent, or Firm*—McGlew and Tuttle

[57] ABSTRACT

The apparatus includes a table on which the documents, received from a conveyor, are stacked on edge. The table is formed with one or more elongated slots extending perpendicularly to the stack of documents, and a rotating disc is mounted beneath each slot for rotation in the general plane of the slot. Each rotating disc has secured thereto one or more flexible narrow strips to extend tangentially therefrom. Responsive to control signals, a disc is rotated so that a flexible narrow strip thereon is inserted through the associated slot to extend between two successive documents of the stack, and the strip can be withdrawn by further rotation of the disc.

7 Claims, 12 Drawing Figures

APPARATUS FOR OPTICALLY MARKING PREDETERMINED POSITIONS IN A STACK OF DOCUMENTS

CROSS REFERENCE TO RELATED PATENT APPLICATION

This application is a continuation-in-part of application Ser. No. 527,763 filed Nov. 27, 1974, and now abandoned, for APPARATUS FOR OPTICALLY MARKING PREDETERMINED POSITIONS IN A STACK OF DOCUMENTS.

FIELD AND BACKGROUND OF THE INVENTION

The present invention relates to an apparatus for optically marking predetermined positions in a stack of documents or for subdividing a stack of documents or the like during the stacking operation.

If papers, documents or other flat objects are to be handled by machine, it may be advantageous to introduce markings for identifying one or more positions of the stacked documents. This may be desirable to separate predetermined numbers of pieces, to set off defective or special parts in the stack, to find a certain position again quickly, or for some other reason. To do this, it is customary to manually insert a mnemonic card which makes it easier to find this position later on. At slow processing speeds, this manual marking is quite workable and sufficient. If, however, a stack of documents is to be read, sorted and made into packages of a predetermined number of pieces by machine, manual marking of the desired positions in the stack would adversely affect the processing speed.

SUMMARY OF THE INVENTION

It is therefore the object of the present invention to provide an apparatus which permits markings to be provided between the documents during the mechanical stacking operation without the latter having to be interrupted or slowed down.

The invention attains this object essentially by providing mechanical means which can be mechanically introduced into the stack of documents between two successive documents in response to control signals.

A preferred embodiment of the invention is characterized in that there is provided at least one rotating disc which is disposed below the stacking table on which the documents stand with their edges, the plane of which rotating disc is perpendicular to the plane of the documents, and to the circumference of which rotating disc is attached at least one flexible narrow strip (separating finger) which, when the rotating disc is in its starting position, extends tangentially away from the rotating disc and which, if the rotating disc is turned through a predetermined angle, reaches through a corresponding slot of the stacking table and lays itself against the document stacked last and, if the turn of the rotating disc is continued, slips out again.

In an improvement, the individual separating fingers may have different features such as numerals, letters or colors thereon which permit the separating fingers to be distinguished from one another. This different design of the separating fingers allows the beginning and the end of a partial stack, for example, to be marked even better or permits a direct indication as to why the separating finger was introduced into the stack.

The invention has the important advantage that the markings can be introduced into the stack purely mechanically and without any manual assistance.

For an understanding of the principles of the invention, reference is made to the following description of typical embodiments thereof as illustrated in the accompanying drawings.

DESCRIPTION OF THE PREFERRED EMBODIMENTS

Figure 1:
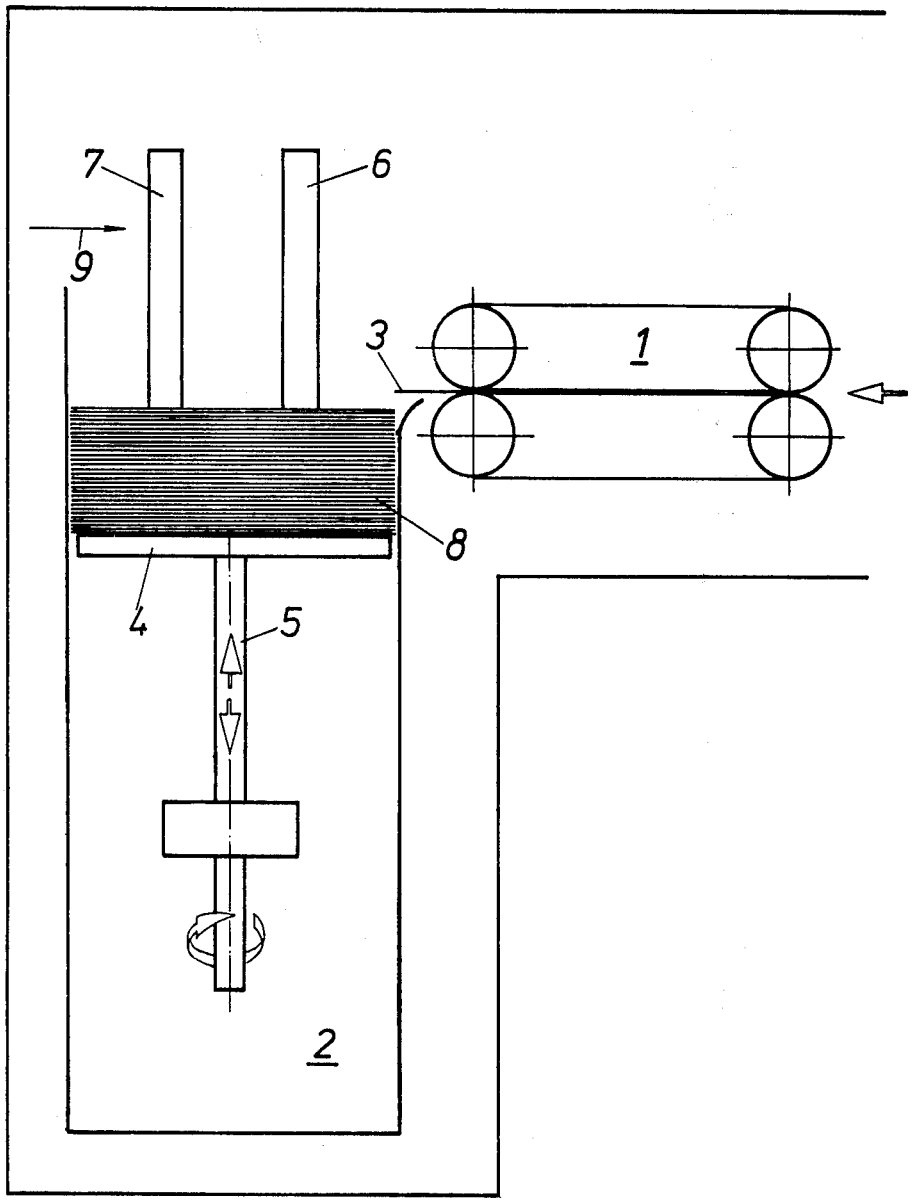
FIG. 1 is a schematic plan view of a conveying system with a following stacking device embodying the invention.

FIG. 1 is a schematic top view of a stacking device to which the invention is applicable. It consists of the belt conveyor system 1 by means of which the documents 3 are slipped onto the stack 8. The stack 8 bears against the *b* earing wall 4, which is adjustable by means of a spindle 5. Since such stacking devices are known in the art, they will not be described here in more detail.

Figure 3:
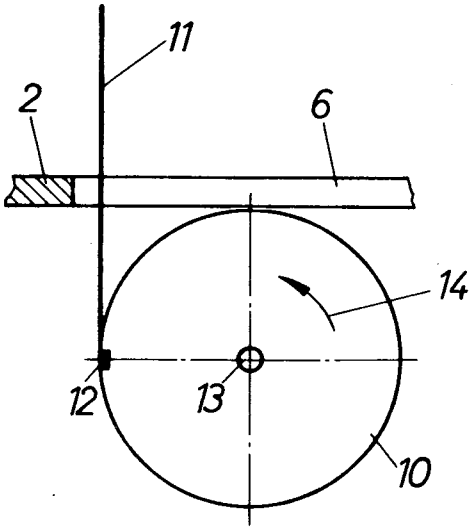
FIGS. 2 and 3 are elevation views of a rotating disc having a separating finger extending tangentially therefrom and shown in two different respective positions.
Figure 2:
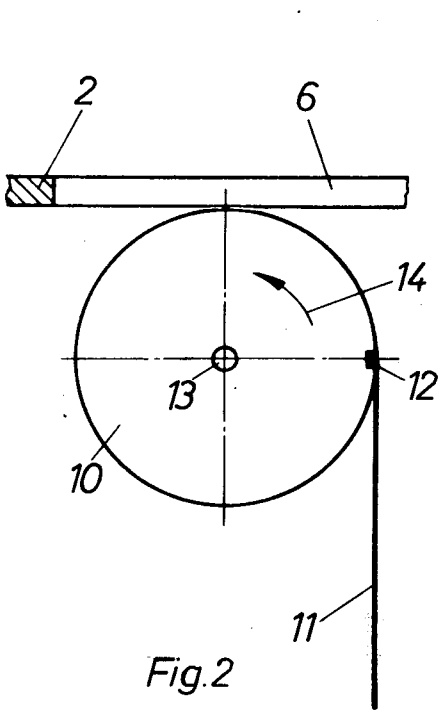

The documents 3 stand with their edges on the stacking table 2, which has two slots 6 and 7, through which the mechanical means for optically marking a predetermined position, or for subdividing the stack, can reach, as will be explained in more detail with reference to FIGS. 2 and 3.

Disposed below the stacking table 2 are two parallel rotating discs. FIG. 2 shows the front rotating disc 10 in the direction of the arrow 9 of FIG. 1. It can be seen that, in the area of the slots 6 and 7, the rotating discs 10 are located directly below the stacking table 2. It can also be seen that a strip 11 (separating finger) is attached to the circumferential point 12 of the rotating disc 10 so as to extend tangentially away from the rotating disc. The rotating disc 10 is rotatable about the axle 13 in the direction of arrow 14. FIG. 3 shows the rotating disc 10 after a turn through 180°. During this turn, the separating finger 11 slides through the opening 6 and lays itself against the last stacked document of the stack of documents 8, which is not shown in FIG. 3.

Figure 4:
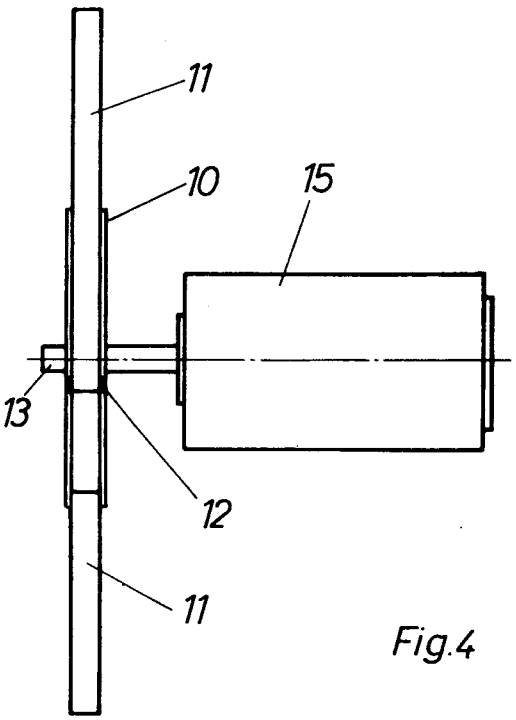
FIG. 4 is a side elevation view of a rotating disc driven by a stepping motor.

FIG. 4 shows the driving motor 15 for the rotating discs 10, which is preferably a stepping motor controlled by a control device (not shown) of the stacking device.

Figure 6:
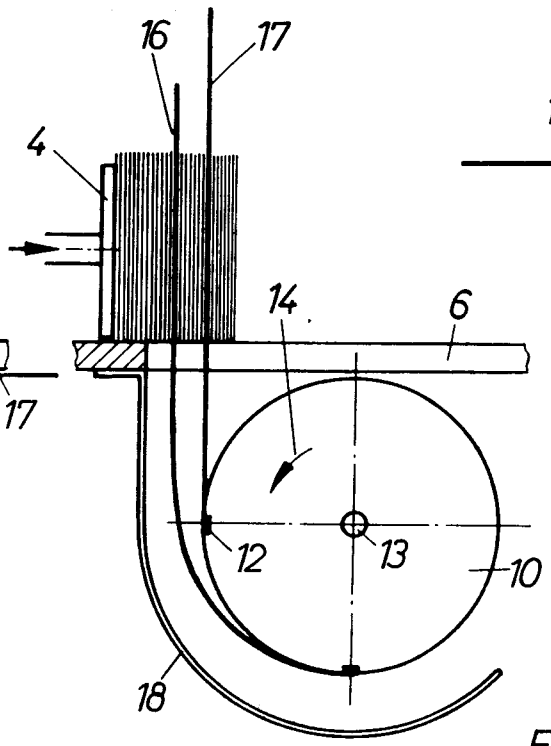
FIG. 6 is an elevation view, partly in section, illustrating a disc provided with two separating fingers.
Figure 5:
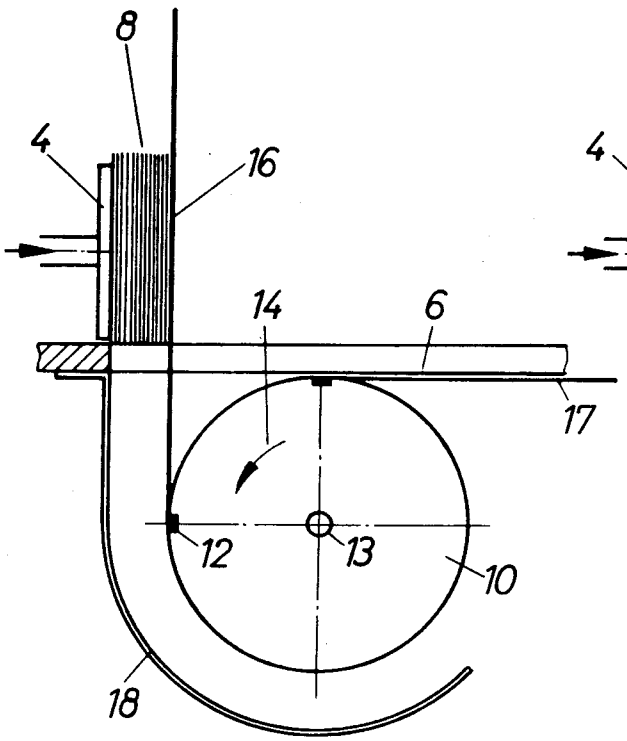
FIG. 5 is an elevation view, partly in section, illustrating a separating finger resting against the document stacked last.

A practical example of the invention will now be explained with the aid of FIGS. 5 and 6.

As can be seen, in this example, two separating fingers 16 and 17 are attached to the rotating disc 10 with a separation of 90°. FIG. 5 shows the condition in which a partial stack has already been formed and the rotating disc 10 has been turned so far that the separating finger 16 has struck against the stack 8 before the next document is stacked. It should be noted that the documents are fed to the stack perpendicularly to the plane of the drawing.

When a predetermined number of additional documents, e.g. 50, have been supplied, the rotating disc is turned again so that the separating finger 17 strikes against the foremost document of the 50-document package before the next document is stacked. Then, further documents are stacked, so that the condition of FIG. 6 follows, in which 50 documents are separated from the remaining stack and can be removed, for example. These operations will take place during stacking, so the stacking process need not be interrupted.

As can be readily seen, it is also possible to form several partial stacks is a correspondingly greater number of separating fingers are attached to the rotating disc. In this case, the lengths and the diameter of the rotating disc 10 must become greater, as taught by FIG. 6. In order that the separating fingers 16, 17 do not require too much space downwards, the chute 18 is provided.

Another possibility of forming several partial stacks is to provide two or more rotating discs which are controllable separately. Since the control of the rotating discs is not the subject matter of the invention and can be suitably designed by those skilled in the art, it will not be explained here in more detail.

It is also possible to make the individual separating fingers of the rotating discs distinguishable from one another by markings. For example, the ends of the separating fingers may be colored differently, in which case a red separating finger may mark the beginning of a partial stack, and a green one the end of a partial stack. Furthermore, numerals, letters, or other symbols may be provided at the separating fingers for the special identification of partial stacks.

Figure 7:
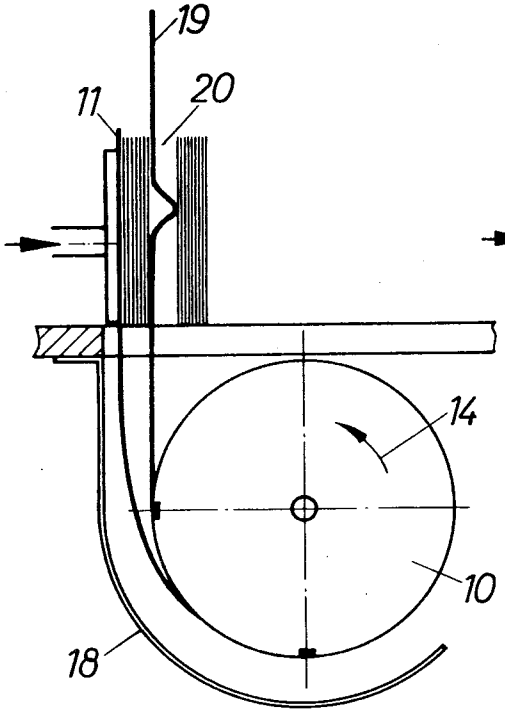

In an improvement, at least one separating finger 19 has a curved or offset portion, as shown in FIG. 7. This provides a gap 20 which facilitates the withdrawal of the partial stack.

Figure 9:
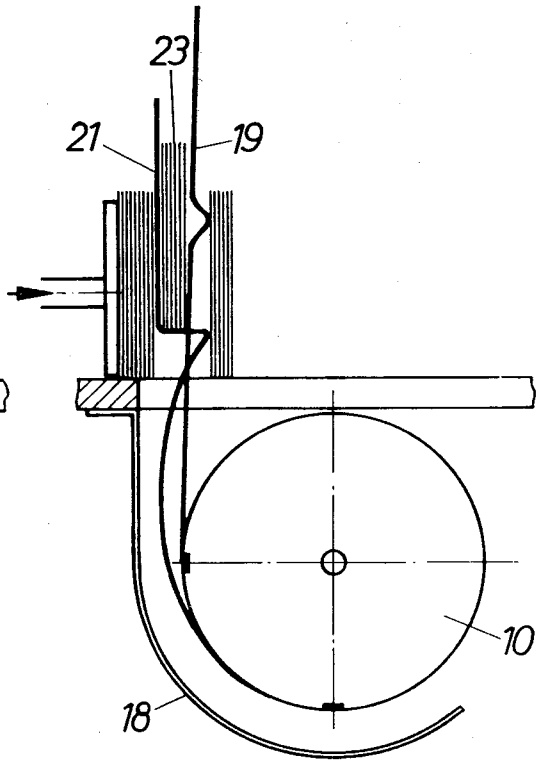
FIGS. 7, 8 and 9 are elevation views illustrating different embodiments of the separating finger.
Figure 8:
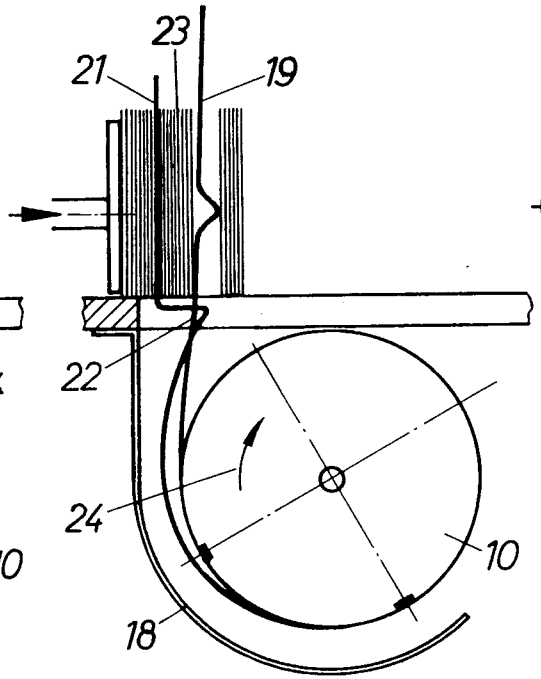

In FIGS. 8 and 9, the separating finger 21 is also deformed, namely so that its nose 22 lies below the partial stack 23 in the applied condition of the two separating fingers 19 and 21. If the rotating disc 10 is moved in the direction of arrow 24, the partial stack 23 is lifted and can be easily withdrawn. To insure the lifting of the partial stack 23 up to a given thickness of the partial stack, the separating finger 19 has a recess in which the nose 22 can slide.

Instead of being deformed, the separating finger 21 may also have a corresponding extension which moves below the partial stack 23. The extension may be provided at the side or on the plane of the separating finger.

The step-by-step rotation of the rotating discs 10 can be effected with a rotary magnet or a step-by-step mechanism, for example. For continuous rotation, a motor with suitable reduction ratio can be used. For especially fast and accurate rotary motions, a stepping motor has proved good, as was explained above. With a stepping motor, switching times of 50 milliseconds can be achieved without difficulty.

Figure 10:
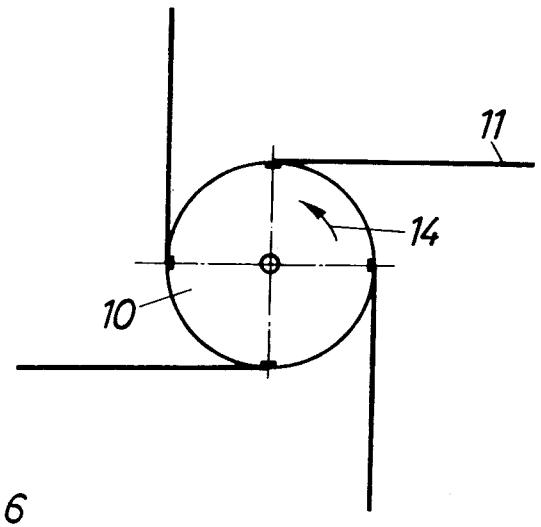
FIG. 10 is a side elevation view of a rotating disc having four separating fingers secured thereto to extend tangentially therefrom.

The examples show rotating discs with one or two separating fingers each. It is also possible to provide three or more separating fingers which may be spaced equal or unequal distances apart. FIG. 10 shows a rotating disc 10 with four equally spaced separating fingers 11.

Figure 11:
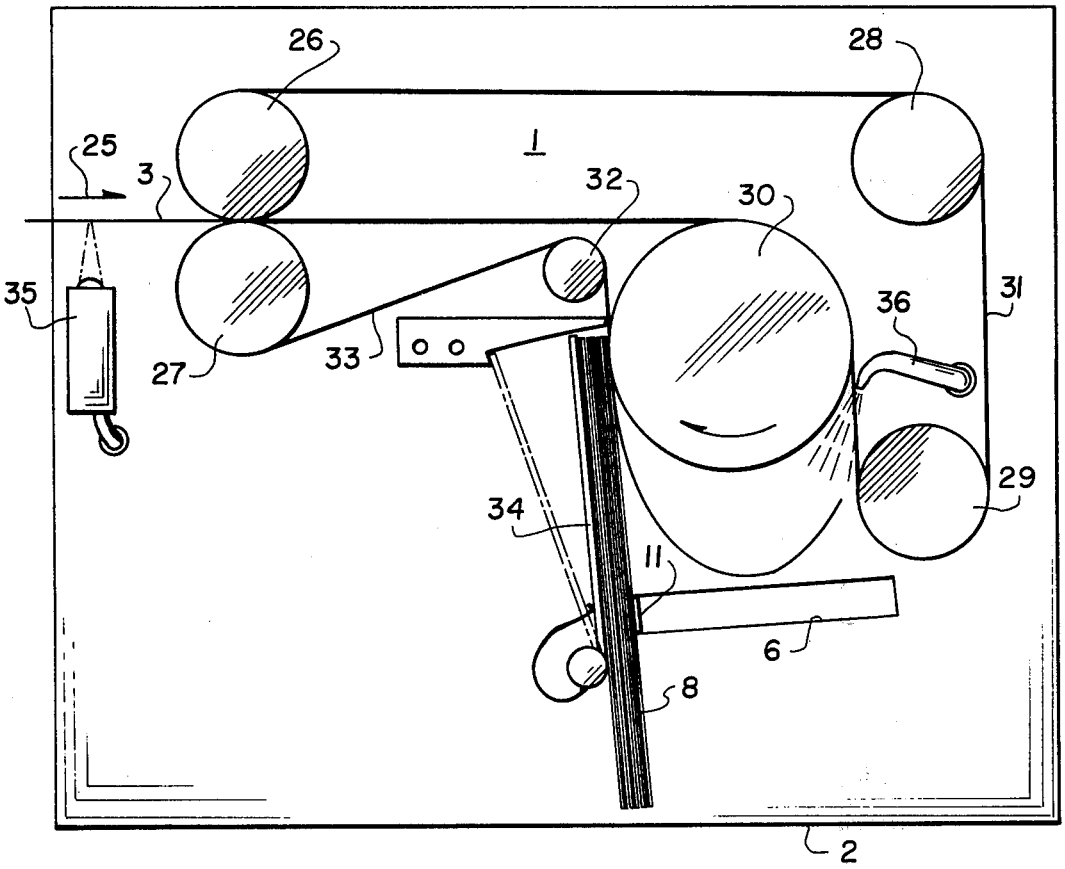
FIG. 11 is a diagrammatic view showing the essentials of FIG. 1 in greater detail.
Figure 12:
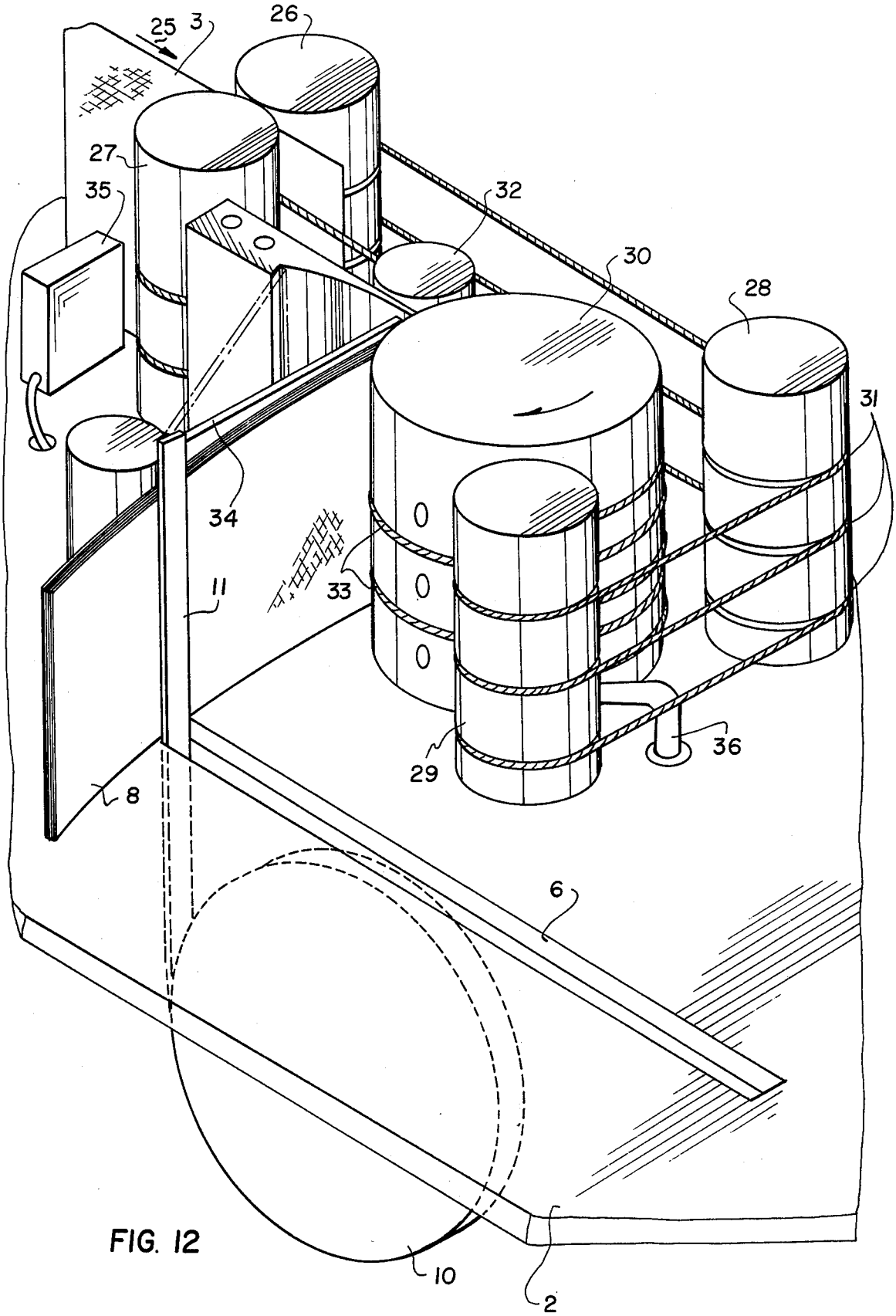
FIG. 12 is a perspective view corresponding to FIG. 11.

Referring to FIGS. 11 and 12, vertically oriented document 3 is supplied to conveyor system 1 in the direction of arrow 25. This conveyor system comprises substantially the feed rollers 26 and 27, guide rollers 28 and 29 and a driven stacking cylinder 30. The three conveyor strips 31, shown in FIG. 12, are looped around rollers 26, 28 and 29 as well as around stacking cylinder 30, while the two opposing conveyor strips 33 are looped around rollers 27 and 32 and stacking cylinder 30. With this arrangement, the document 3 can be picked up at the entrance of the conveyor system and advanced, around stacking cylinder 30, to the stack 8 placed on stacking table 2.

The operation of stacking cylinder 30 will not be described, since this does not form the subject matter of the present invention and, for the same reason, the blast nozzle 36 will not be explained in more detail. However, from FIGS. 11 and 12, it will be evident that documents 3 are stacked on edge on stacking table 2.

The stack 8 is held in its vertical orientation by stack presser 34 on the one side and by stacking cylinder 30 on the other side. As thin documents are stacked, the flexible finger 11 may also serve as a support of the stack. As illustrated, finger 11 projects through slot 6 of stacking table 2 which, as illustrated in FIGS. 11 and 12, is a single slot rather than the two slots shown in FIG. 1. This finger 11 is secured tangentially to rotatable disc 10 which is mounted below stacking table 2, and whose drive mechanism has not been shown since such mechanisms are well known to those skilled in the art.

Rotatable disc 10 is controlled by a light-barrier equipment 35 which is connected to corresponding electric circuits and, if necessary, to a counter. As such control circuits are well known in the art, their explanations would appear to be superfluous.

While specific embodiments of the invention have been shown and described in detail to illustrate the application of the principles of the invention, it will be understood that the invention may be embodied otherwise without departing from such principles.

What is claimed is:

1. In apparatus for optically marking predetermined positions in a stack of documents, such as for subdividing a stack of documents, during the stacking operation, with the aid of mechanical means which, in response to control signals, can be mechanically introduced into the stack of documents between two successive documents, the improvement comprising, in combination, a horizontally oriented stacking table arranged to support a stack of vertically oriented documents stacked on edge thereon; a vertically oriented support movable horizontally relative to said stacking table and arranged to support the stack of documents stacked on edge on said stacking table; conveyor means operable to feed vertically oriented documents successively to said stacking table for forming a stack of vertically oriented documents stacked on edge on said stacking table and supported by said support in a vertically oriented condition; at least one elongated slot formed in said stacking table and extending perpendicularly to the stack of documents; at least one rotatable disc disposed beneath said stacking table in alignment with a slot therein, the plane of rotation of each rotatable disc being perpendicular to the stack of documents; and at least one flexible narrow strip, forming a separating finger, secured to the circumference of each rotatable disc and, when the disc is in a starting position, extending tangentially away from the associated rotatable disc beneath said stacking table; each flexible narrow strip, when the associated rotatable disc is turned through a predetermined angle from its starting position extending vertically through the associated slot of the stacking table and engaging against the last document added to the stack and, responsive to rotation of the associated rotatable disc through a further angle in the same direction, slipping out through the associated slot again.

2. Apparatus according to claim 1, in which each separating finger is sufficiently long so as to project from the stack in the inserted condition.

3. Apparatus according to claim 1, in which the individual separating fingers have different respective features permitting them to be distinguished from one another.

4. Apparatus according to claim 1, in which, for the marking of a partial stack, each rotating disc has two separating fingers secured thereto to extend tangentially therefrom, and including a leading and a trailing separating finger; the trailing separating finger having an offset portion projecting therefrom for separating the partial stack from subsequently stacked documents.

5. Apparatus according to claim 1, in which, for the marking of a partial stack, each rotating disc has two separating fingers secured thereto to extend tangentially therefrom, the two fingers constituting a leading and a trailing separating finger; the leading separating finger having a steplike extension extending in the direction of the bottom edges of the stacked documents.

6. Apparatus according to claim 5, in which said extension is constituted by a deformation of the leading separating finger.

7. Apparatus according to claim 5, in which the trailing separating finger has a recess in which the extension of the leading separating finger slides.

* * * * *